US007654946B2

(12) United States Patent
Calugi

(10) Patent No.: US 7,654,946 B2
(45) Date of Patent: Feb. 2, 2010

(54) MACHINE FOR COVERING PACKAGING BOXES

(75) Inventor: Candido Calugi, Florence (IT)

(73) Assignee: Emmeci S.p.A., Milan (IT)

( * ) Notice: Subject to any disclaimer, the term of this patent is extended or adjusted under 35 U.S.C. 154(b) by 525 days.

(21) Appl. No.: 11/166,191

(22) Filed: Jun. 27, 2005

(65) Prior Publication Data

US 2005/0288164 A1 Dec. 29, 2005

(30) Foreign Application Priority Data

Jun. 29, 2004 (IT) ..... BO04A0408

(51) Int. Cl.
*B31B 15/00* (2006.01)
*B31B 15/26* (2006.01)

(52) U.S. Cl. ..... 493/111; 493/113; 493/153; 493/386; 493/475; 493/476

(58) Field of Classification Search ..... 493/84, 493/89, 95, 98, 100, 111, 113–115, 121, 493/143, 152, 153, 162, 167, 386, 475, 476; 53/218

See application file for complete search history.

(56) References Cited

U.S. PATENT DOCUMENTS 690,377 A * 12/1901 Smith ..... 493/113
753,524 A * 3/1904 Smith ..... 493/111
1,185,507 A * 5/1916 Hult et al. ..... 493/111
1,187,194 A * 6/1916 Smith ..... 493/111
1,424,316 A * 8/1922 Morrison ..... 493/386
1,592,264 A * 7/1926 Gooding ..... 493/111
1,657,642 A * 1/1928 Pouzar ..... 493/476
1,692,831 A * 11/1928 Hanshe ..... 493/386
1,829,063 A * 10/1931 Seckendorf ..... 493/113
2,246,858 A * 6/1941 Phelps ..... 493/113
2,604,828 A * 7/1952 Langdon ..... 493/113
2,713,813 A * 7/1955 Triolo ..... 493/113
2,750,097 A * 6/1956 Moore ..... 493/111
2,808,693 A * 10/1957 Guggenheim ..... 493/476
2,867,158 A * 1/1959 Andresen, Jr. et al. ..... 493/111
3,280,706 A * 10/1966 Bradicich et al. ..... 493/476
3,492,784 A * 2/1970 Vitols et al. ..... 493/111
3,657,976 A * 4/1972 Fish ..... 493/111
3,802,280 A * 4/1974 Shelmire ..... 493/113

FOREIGN PATENT DOCUMENTS

EP 0 685 329 A2 12/1995
IT 1224973 7/1988
IT FI940110 1/1995

* cited by examiner

*Primary Examiner*—Stephen F Gerrity
(74) *Attorney, Agent, or Firm*—Pearne & Gordon LLP

(57) ABSTRACT

A machine for covering packaging boxes (S) with a sheet (F) comprises at least one presser (10) and one folding blade (11) that move horizontally to apply the edges (L) of a glued sheet (F) to corresponding outside walls (P) of a box (S). The presser (10) and/or the blade (11) are adjustable in angular position with respect to one or more axes of rotation.

11 Claims, 3 Drawing Sheets

MACHINE FOR COVERING PACKAGING BOXES

BACKGROUND OF THE INVENTION

The present invention addresses the packaging box industry and, in particular, relates to a machine for covering boxes with a pre-glued sheet.

In prior art, covering sheets are applied to formed boxes using machines known as "gluing machines".

Examples of these machines form the subject matter of patents IT1224973 and IT1269105 to the Applicant.

These machines comprise a conveying system which transports the box to a covering unit which applies the glued sheet to the walls of the box in such a way as to completely cover the box.

At present, prior art covering machines rollers or brushes which move vertically relative to the outside walls of the box and which move the edges of the covering sheet into contact with the corresponding walls of the box.

To complete the box covering, there are also pressing means that move close to the outside surfaces of the box and horizontal blades that line up with the upper edges of the walls to be covered.

The blades can move relative to the pressing means and, once the pressing means have moved close to the box, they continue moving towards the box and push the edges of the covering sheet over the free upper edges of the box in such a way that the edges of the covering sheet protrude towards the inside of the box.

Next, the blades are moved away from the box again and a suitably shaped pad is inserted into the box in such a way as to press the edges of the covering sheet against the inside walls of the box.

Lastly, once the boxes have been covered completely, the boxes are fed out of the covering machine.

These prior art covering machines, however, are unsuitable for use on boxes with irregularly shaped sides, that is to say, when the wall to be covered is not perpendicular to the direction in which the pressing means and blades move towards the box or when the wall to be covered is at an angle to the horizontal, thus making it difficult to use horizontal folding blades.

Up to now, boxes of this kind were dealt with using manual expedients such as, for example, wedges or shims to adapt the position and angle of the pressing means and blades to the shape of the box.

Obviously, the need for manual operations involves higher costs and less precision and repeatability.

SUMMARY OF THE INVENTION

The present invention therefore has for an aim to overcome these drawbacks by providing a packaging box covering machine that is highly flexible in operation and that is easy to use and adapt to boxes of different shapes and sizes.

In accordance with the invention, this aim is achieved by a box covering machine as defined in the appended claims.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

The accompanying drawings illustrate a box covering machine according to the invention.

Figure 1:
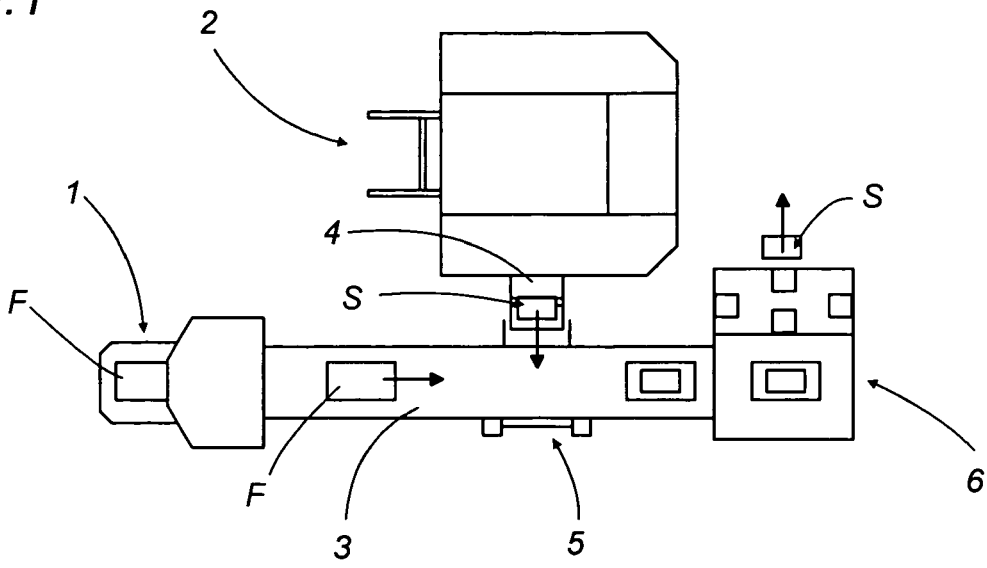
FIG. 1 is a schematic assembly diagram of a line for the production of covered boxes.

The covering machine can be used in a covering line of the type illustrated in FIG. 1 which schematically shows a unit 1 for gluing covering sheets F and a unit 2 for erecting the boxes S to be covered.

The sheets F and the boxes S are transported by respective conveyors 3, 4 which meet at a placing station 5 from which a succession of boxes S placed on glued sheets F are fed to the covering unit 6.

The system for conveying the boxes S and the sheets F is of customary type and therefore not further described.

Figure 2:
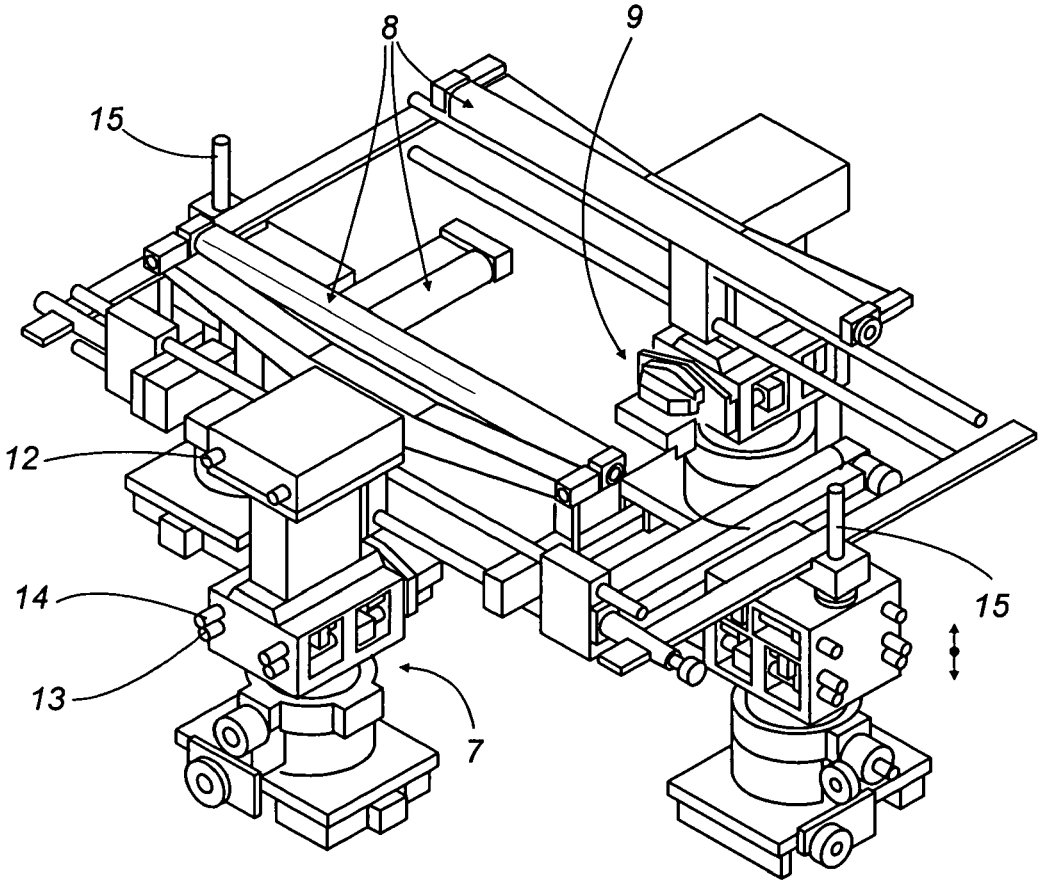
FIG. 2 schematically illustrates a box covering unit according to the invention.

FIG. 2 schematically illustrates the basic functional components of a covering unit 6 according to the invention.

The unit 6 comprises four columns 7, each forming part of a covering head 9 comprising a horizontal pressure roller 8, a presser 10 and a folding blade 11.

In the embodiment described, the unit 6 comprises two pairs of opposite covering heads 9 positioned at the side walls P of a box S to be covered with a glued sheet F.

Preferably, the rollers 8 of the units 9 at the short side walls of the box S can move up and down on vertical guides 15, while the rollers 8 at the long side walls are vertically fixed on the respective columns 7. It will be understood, however, that in different embodiments of the machine, all or some of the heads 9 may be adjusted in height.

On the other hand, the pressers 10 and the blades 11 mounted on the heads 9 can move horizontally and independently of each other on respective guides 13, 14 that slide through the column 7.

Figure 2A:
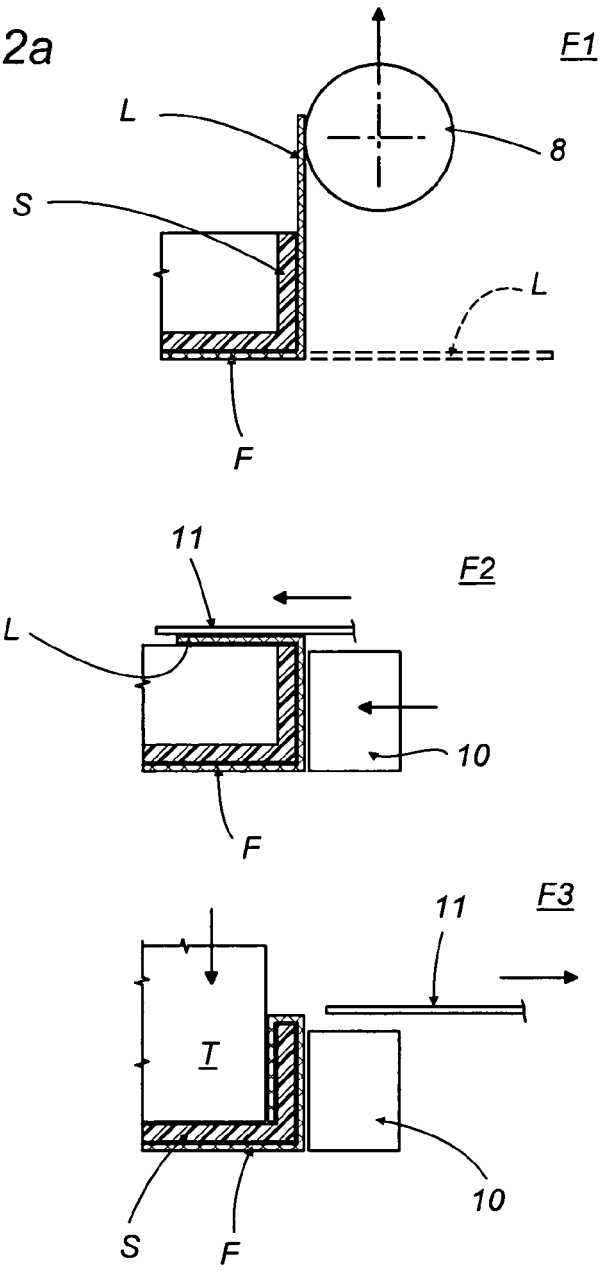
FIG. 2*a* illustrates the steps of covering a box.

FIG. 2*a* schematically illustrates the steps of the covering cycle—a per se known cycle—in which the rollers 8, during the downward movement of the box S (or the upward movement of the roller, depending on the side being covered), press the sheet F against the side walls of the box, thereby making the outside cover (step F1), while the presser 10 and the blade 11 then move into contact with the box S to push the outer edge L of the sheet F over the free upper edge of the box in such a way that it protrudes towards the inside of the box (step F2) and so that, in the next step F3, a pad T can be inserted into the box so as to press the ends of the sheet F against the inside walls of the box, thus completing the cover of the box side walls.

Figure 2B:
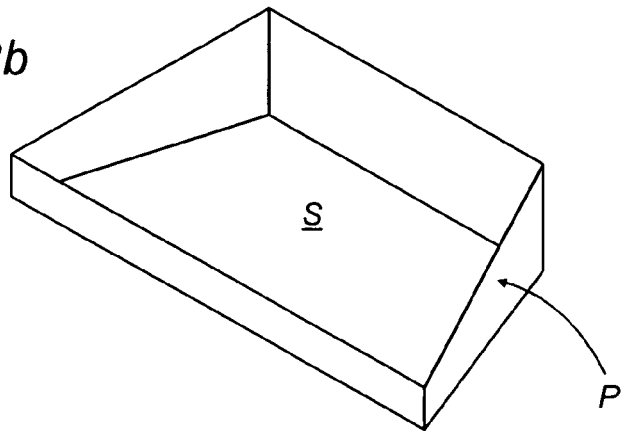
FIG. 2*b* shows a box, with a generic non-square shape, to be covered.
Figure 3:
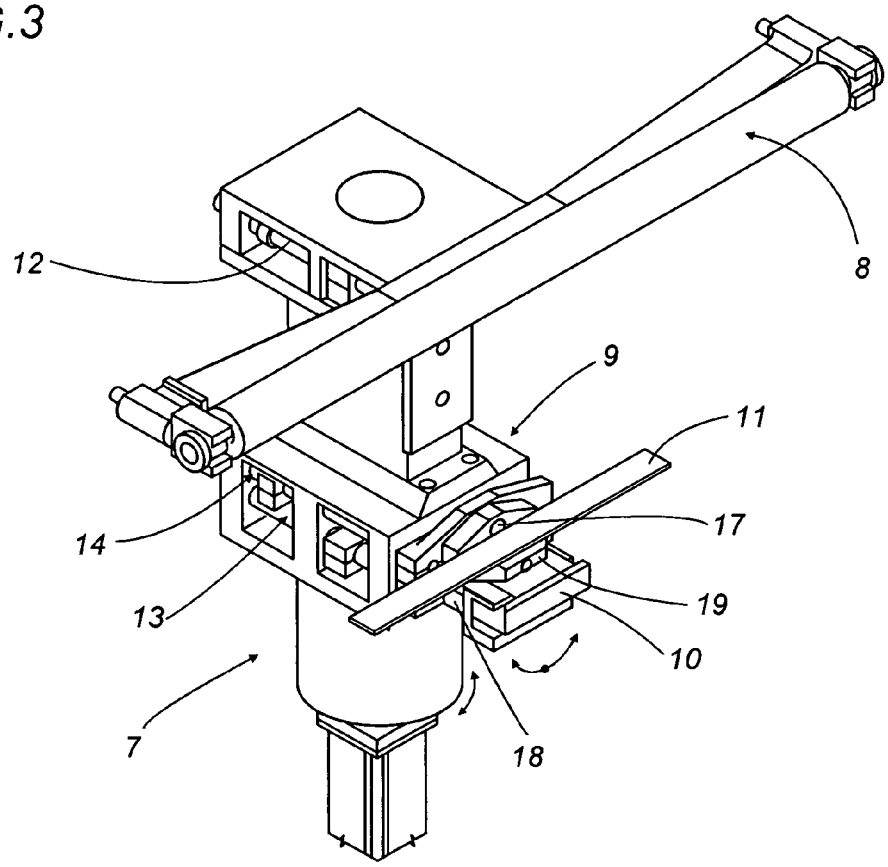
FIG. 3 illustrates a detail of a covering head forming part of a unit as in FIG. 2.
Figure 4:
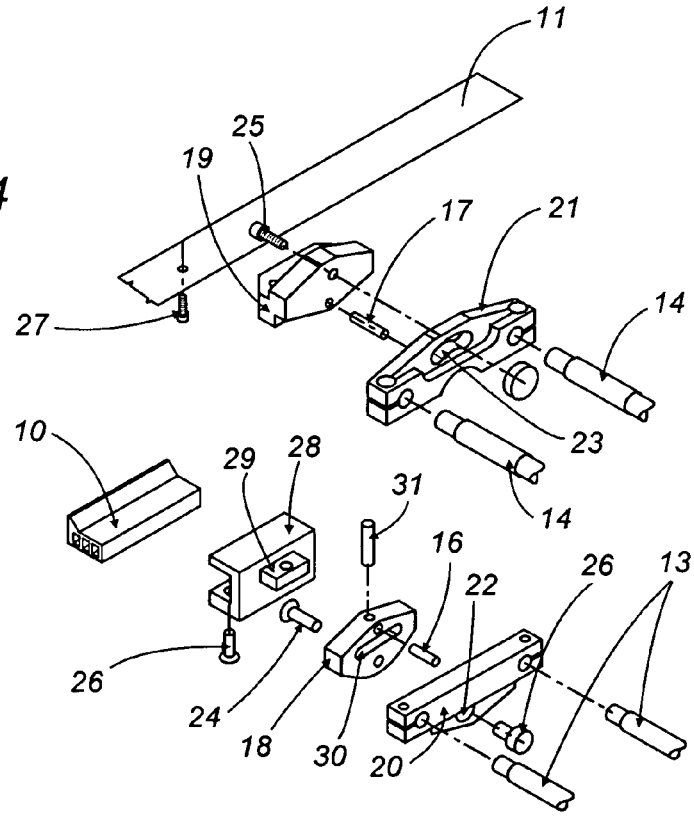
FIG. 4 is an exploded view of the presser and blade mounting blocks fitted to the head illustrated in FIG. 3.

Described below with reference to FIG. 2-4 is a preferred embodiment of the invention in which the pressers 10 and the blades 11 can be adjusted in position in order to adapt to boxes S of different shapes having, for example (FIG. 2*b*), a trapezoidal base or upper edges of walls P that are at an angle to the horizontal.

For this purpose, the pressers and the blades can be adjusted with respect to one or more axes of rotation, in particular with respect to a vertical axis, by rotation of the column 7, or with respect to a horizontal axis, since they can rotate on respective pins 16, 17.

Looking in more detail, the pressers 10 and the blades 11 are mounted by screw means 26, 27 on respective adjustment blocks 18, 19, each fixed to a supporting plate 20, 21.

More specifically, the presser 10 is fixed to an intermediate support 28 that can be fixed to the block 18 through a plug 29 that can be inserted into a socket 30 in the block 18 and locked in place by a key 31.

Thanks to this solution, the presser 10 can be easily changed-by simply pulling out the key 31 and substituting an intermediate support 28 mounting a presser of the required shape and size.

The supporting plates 20, 21 can also slide on the guides 13, 14 and have circular slots 22, 23 in them to adjust the angular position of the blocks 18, 19 (and hence of the pressers 10 and blades 11).

Thus, as illustrated in FIG. 4, the blocks 18, 19 can rotate on horizontal pins 16, 17, which are inserted in the plates 20, 21, and can be tightened in position by respective screws 24, 25 and counterscrews 26, 27.

Advantageously, the adjustment blocks 18, 19 of the pressers 10 and folding blades 11 are reciprocally mobile and can be adjusted independently of each other so as to allow separate adjustment for each box shape to be covered.

It will be understood that the invention described, useful in many industrial applications, may be modified and adapted in several ways without thereby departing from the scope of the inventive concept and that all the details of the invention may be substituted by technically equivalent elements.

What is claimed is:

1. A machine for covering a packaging box with a glued sheet, comprising a first covering head mounted on a first column and a second covering head mounted on a second column, the first covering head having a first presser and a first folding blade, each of said first presser and said first folding blade being movable horizontally in a direction towards a box to apply a glued sheet to a corresponding first sidewall of the box, the second covering head having a second presser and a second folding blade, each of said second presser and said second folding blade being movable horizontally in a direction towards the box to apply the glued sheet to a corresponding second sidewall of the box, said first column being independently rotatable about a first vertical axis of rotation so that the first covering head, the first presser and the first folding blade are also rotatable about the first vertical axis of rotation, said second column being independently rotatable about a second vertical axis of rotation so that the second covering head, the second presser and the second folding blade are also rotatable about the second vertical axis of rotation, so that (a) in a first position, the machine can apply a glued sheet to the first sidewall and an adjacent sidewall wherein the first and adjacent sidewalls define a right angle, and (b) in a second position, the machine can apply a glued sheet to the first sidewall and an adjacent sidewall wherein the first and adjacent sidewalls define an oblique angle.

2. The machine of claim 1, wherein said first presser is rotatable about a first horizontal axis of rotation and wherein said first folding blade is rotatable about a second horizontal axis of rotation.

3. The machine of claim 2, wherein said second presser is rotatable about a third horizontal axis of rotation and wherein said second folding blade is rotatable about a fourth horizontal axis of rotation.

4. The machine of claim 2, wherein said first horizontal axis of rotation is parallel to said second horizontal axis of rotation.

5. The machine of claim 1, wherein each of said first and second covering heads is adjustable in vertical position so that each of said first and second pressers and each of said first and second folding blades is adjustable in vertical position.

6. The machine of claim 1, wherein the first presser is mounted on an adjustment block that can (a) move horizontally, (b) rotate about a horizontal pin, and (c) be fixed in angular position.

7. The machine of claim 6, wherein the first folding blade is mounted on an adjustment block that can (a) move horizontally, (b) rotate about a horizontal pin, and (c) be fixed in angular position.

8. The machine of claim 7, wherein the first presser adjustment block and the first folding blade adjustment block are reciprocally mobile and can be adjusted independently of each other.

9. The machine of claim 7, wherein the first presser adjustment block and the first folding blade adjustment block are mounted on said first covering head, and wherein said first covering head is adjustable in vertical position.

10. The machine of claim 1, wherein the first folding blade is mounted on an adjustment block that can (a) move horizontally, (b) rotate about a horizontal pin, and (c) be fixed in angular position.

11. The machine of claim 1, further comprising a third covering head mounted on a third column and a fourth covering head mounted on a fourth column, said third column being independently rotatable about a third vertical axis of rotation, said fourth column being independently rotatable about a fourth vertical axis of rotation.

* * * * *

UNITED STATES PATENT AND TRADEMARK OFFICE

CERTIFICATE OF CORRECTION

PATENT NO. : 7,654,946 B2
APPLICATION NO. : 11/166191
DATED : February 2, 2010
INVENTOR(S) : Candido Calugi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 755 days.

Signed and Sealed this

Twenty-third Day of November, 2010

David J. Kappos

David J. Kappos
*Director of the United States Patent and Trademark Office*